US007791477B2

(12) United States Patent
Sharma

(10) Patent No.: US 7,791,477 B2
(45) Date of Patent: Sep. 7, 2010

(54) METHOD AND APPARATUS FOR ANALYZING VIDEO DATA OF A SECURITY SYSTEM BASED ON INFRARED DATA

(75) Inventor: Raman Kumar Sharma, Toronto (CA)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 344 days.

(21) Appl. No.: 11/504,865

(22) Filed: Aug. 16, 2006

(65) Prior Publication Data

US 2008/0043101 A1 Feb. 21, 2008

(51) Int. Cl.
*G08B 13/18* (2006.01)

(52) U.S. Cl. ..... 340/567; 348/143

(58) Field of Classification Search ..... 340/541, 340/567; 348/143, 152–155, 159; 382/103
See application file for complete search history.

(56) References Cited

U.S. PATENT DOCUMENTS 5,473,368 A * 12/1995 Hart ..... 348/155
5,555,512 A * 9/1996 Imai et al. ..... 702/127
5,980,123 A * 11/1999 Heifler ..... 340/567
6,081,606 A * 6/2000 Hansen et al. ..... 382/107
6,476,859 B1 * 11/2002 Galloway et al. ..... 348/143
2002/0163577 A1 * 11/2002 Myers ..... 348/152
2006/0242186 A1 * 10/2006 Hurley ..... 707/102

* cited by examiner

*Primary Examiner*—Thomas J Mullen
(74) *Attorney, Agent, or Firm*—The Small Patent Law Group LLP

(57) ABSTRACT

A security system comprises a surveillance unit comprising a visible light camera detecting video data from within a first field of view (FOV) and an infrared (IR) imager detecting IR data within the first FOV. An IR detection module determines whether at least a portion of the IR data is one of within a predetermined IR range, above a predetermined IR threshold, and below a predetermined IR threshold. A processor identifies a region of interest (ROI) within the video data to be further analyzed based on an output of the IR detection module.

18 Claims, 5 Drawing Sheets

METHOD AND APPARATUS FOR ANALYZING VIDEO DATA OF A SECURITY SYSTEM BASED ON INFRARED DATA

BACKGROUND OF THE INVENTION

This invention relates generally to security systems, and more particularly, to detecting the presence of and/or tracking animate objects within an area monitored by a security system.

Security systems typically use a variety of different detecting devices within a building or other monitored area. Motion sensors or detectors may be used to alert security personnel to the presence of an intruder. Unfortunately, motion detectors are deficient in pinpointing an intruder's specific location and do not provide adequate information if the person is stationary. Motion detectors also cannot identify the source of the motion, which may be an inanimate object falling from a shelf, a small animal, or personnel authorized to be in the area, and thus a false alarm may be generated, resulting in unnecessary deployment of personnel to check the area. Also, intruders may create diversions by activating motion sensors to draw security personnel away to a different area.

A security system may also use one or more video cameras to view desired areas. Analyzing the video content using a digital signal processor (DSP) is costly and requires a large amount of power. Complex techniques which burden a large DSP may be used to isolate an intruder within the video or image frame. The isolation processes may not work satisfactorily in low light or when the acquired video is low contrast, however, and the locations of people and/or animals may be difficult to detect.

Therefore, a need exists for a security system that can detect the presence of intruders and lower the number of false alarms. Certain embodiments of the present invention are intended to meet these needs and other objectives that will become apparent from the description and drawings set forth below.

BRIEF DESCRIPTION OF THE INVENTION

In one embodiment, a security system comprises a surveillance unit comprising a visible light camera detecting video data from within a first field of view (FOV) and an infrared (IR) imager detecting IR data within the first FOV. An IR detection module determines whether at least a portion of the IR data is one of within a predetermined IR range, above a predetermined IR threshold, and below a predetermined IR threshold. A processor identifies a region of interest (ROI) within the video data to be further analyzed based on an output of the IR detection module.

In another embodiment, a method for detecting an intruder with a security system comprises acquiring video data representative of a first FOV. IR data is acquired representative of the first FOV. The IR data forms a matrix of IR values. A first ROI is identified based on at least one predetermined IR parameter. The video data is analyzed within the first ROI to determine if an intruder is present within the FOV.

In another embodiment, a security system comprises a visible light camera detecting video data within a first FOV. An IR imager comprises a matrix of IR sensors. The IR sensors detect levels of IR data within the first FOV. Means for identifying the IR sensors detecting levels of IR data within predetermined parameters is provided, and a processor processes the video data corresponding to the identified IR sensors.

Figure 1:
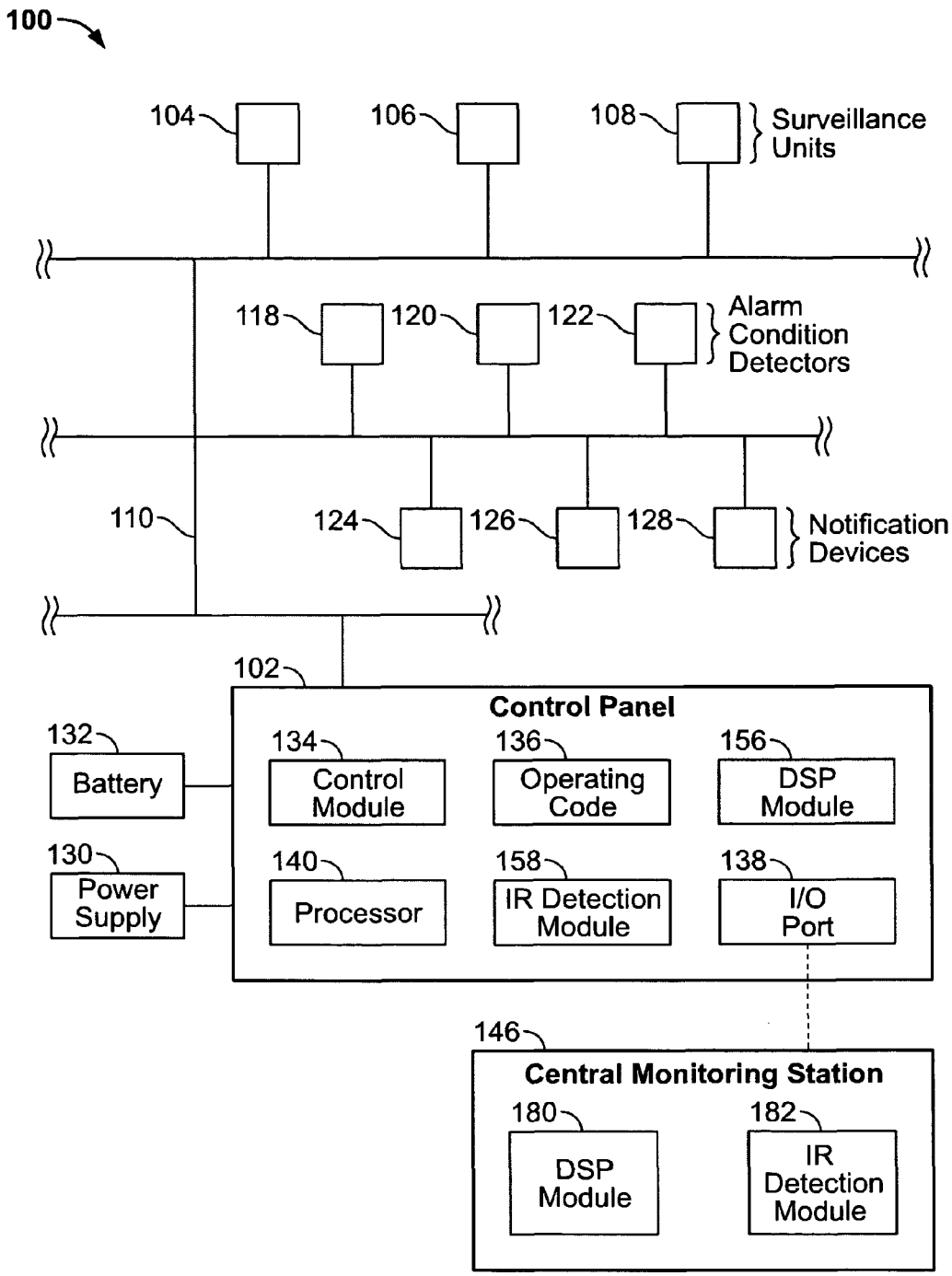
FIG. 1 illustrates a security system which has a system control panel for monitoring and/or controlling devices installed on a network in accordance with an embodiment of the present invention.

The foregoing summary, as well as the following detailed description of certain embodiments of the present invention, will be better understood when read in conjunction with the appended drawings. To the extent, that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or a block or random access memory, hard disk, or the like). Similarly, the programs may be stand alone programs, may be incorporated as subroutines in an operating system, may be functions in an installed software package, and the like. It should be understood that the various embodiments are not limited to the arrangements and instrumentality shown in the drawings.

DETAILED DESCRIPTION OF THE INVENTION

FIG. 1 illustrates a security system 100 which has a system control panel 102 for monitoring and/or controlling devices installed on a network 110. The devices may detect and/or monitor locations and movement of people, animals and machines, detect and/or control door openings and closings, detect alarm conditions, notify people within an area about alarm conditions, or accomplish other security functions which may be desired. For example, the system 100 may be used within a light industrial building or a residence.

The system 100 has one or more surveillance units, such as first surveillance unit 104, second surveillance unit 106 and N surveillance unit 108. Each of the first through N surveillance units 104-108 may have a visible light camera and an infrared (IR) imager housed within a single cover. Each of the first through N surveillance units 104-108 detect image data and IR data within a single field of view (FOV). IR data results from the detection of IR radiation. The FOV of each surveillance unit may be different from any other surveillance unit, or a surveillance unit may have a FOV which at least partially overlaps with the FOV of at least one other surveillance unit.

Alarm condition detectors 118, 120 and 122 may be connected on the network 110 and are monitored by the system control panel 102. The detectors 118-122 may detect fire, smoke, temperature, chemical compositions, or other hazardous conditions. When an alarm condition is sensed, the system control panel 102 transmits an alarm signal to one or more notification device 124, 126 and/or 128 through the network 110. The notification devices 124, 126 and 128 may be horns and/or strobes, for example, and may be addressable or non-addressable notification devices as discussed further below.

The system control panel 102 is connected to a power supply 130 which provides one or more levels of power to the system 100. One or more batteries 132 may provide a back-up power source for a predetermined period of time in the event of a failure of the power supply 130 or other incoming power. Other functions of the system control panel 102 include showing the status of the system 100, resetting a part or all of the system 100, silencing signals, turning off strobe lights, and the like.

The network 110 is configured to carry power and communications to the addressable notification devices from the system control panel 102. Each addressable notification device 124-128 has a unique address and both sends and receives communications to and from the system control panel 102. The addressable notification devices 124-128 may communicate their status and functional capability to the system control panel 102 over the network 110. In contrast, a notification signal sent on the network 110 from the system control panel 102 will be received and processed by each non-addressable notification device. The first through N image surveillance units 104-108 also each have a unique address and send acquired video and IR data to the system control panel 102. The system control panel 102 may processor 164 transmits the video data and the IR data to the control panel 102 over the network 110. The processor 164 may acquire video and IR data in frames or snapshots at predetermined time intervals depending upon a desired configuration. For example, it may be desirable to acquire a frame of data every second or 5 seconds when no trouble condition is being investigated, then acquire frames of data more frequently, such as every half second, when analysis and processing is desired. Alternatively, the video and IR data may be acquired as streaming data or other data format, the resolution of the video data may be varied based on desired configuration or setting, and the like.

The control panel 102 may have one or both of the DSP module 156 and IR detection module 158. The IR detection module 158 processes the IR data from the IR imager 152 to determine whether a heat generating object is present within the FOV. For example, any body having a temperature above absolute zero will radiate at least a minimal amount of radiation. The intensity and frequency distribution of the radiation depends on the detailed structure of the body. Humans radiate a portion of their energy as electromagnetic radiation, most of which is in the infrared range, which has a wavelength longer than visible light and shorter than radio waves. Optionally, the IR detection module 158 may filter the IR data with filter 159 to determine if IR radiation having desired intensity, wavelength and/or frequency is detected.

The DSP module 156 analyzes and processes the video data from the visible light camera 150 based on input from the IR detection module 158. Alternatively, the processor 140 may transmit the video and IR data to the central monitoring station 146 for analysis and/or processing by the DSP module 180 and IR detection module 182, or may transmit the video and IR data after a heat generating object is detected by the IR detection module 158.

Figure 2:
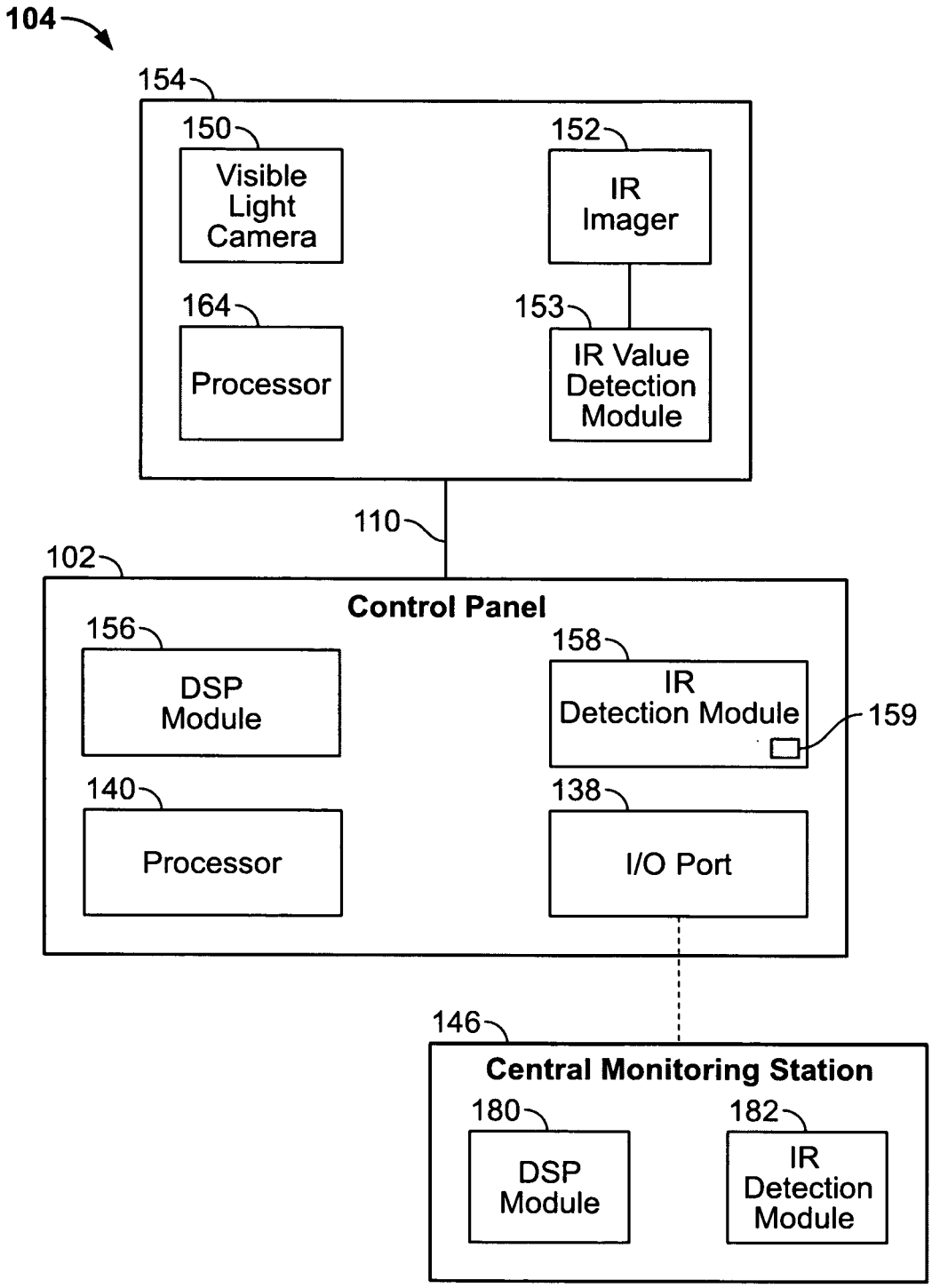
FIG. 2 illustrates a block diagram of the first surveillance unit in accordance with an embodiment of the present invention.
Figure 3:
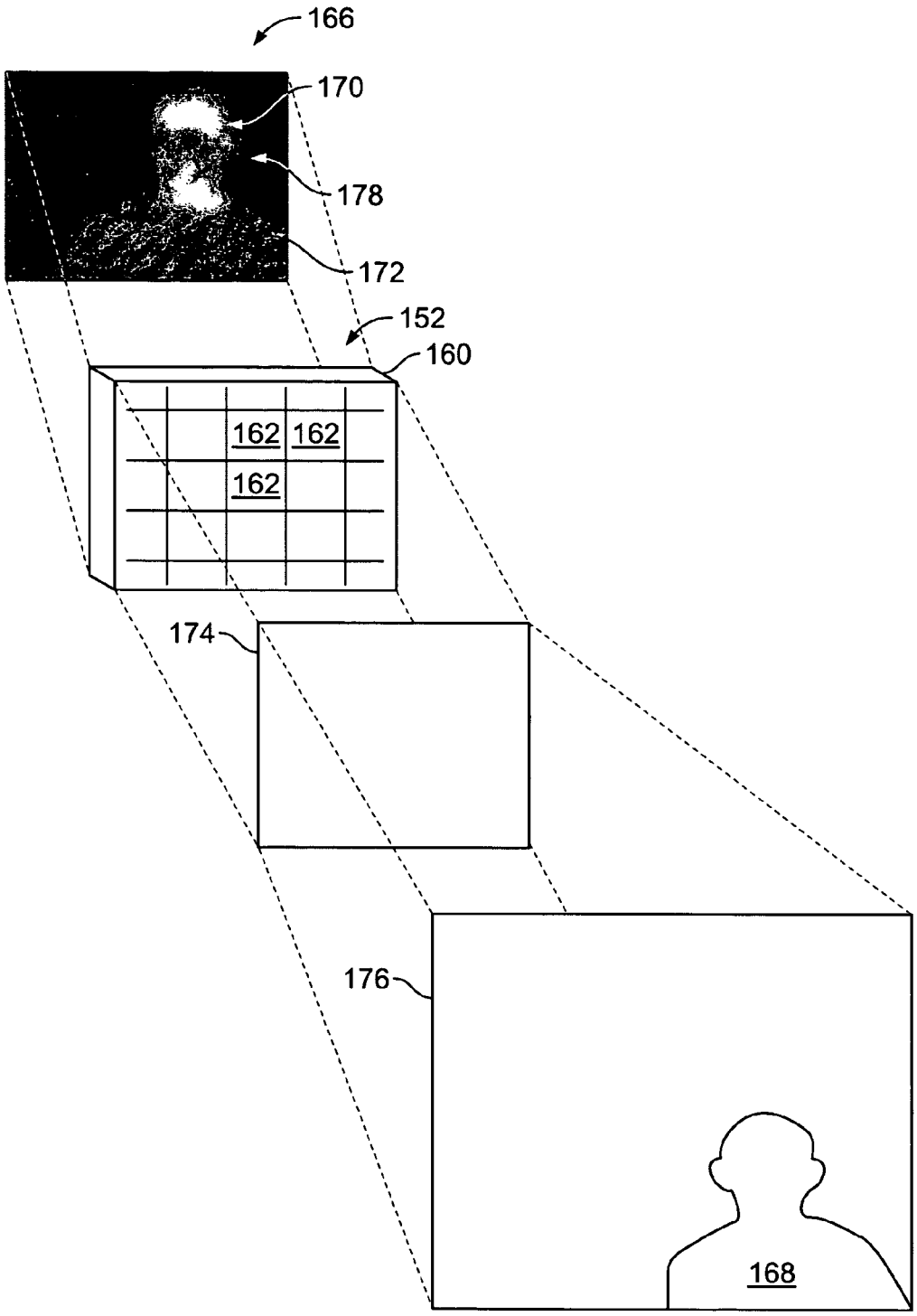
FIG. 3 illustrates the IR imager within the first surveillance unit of FIG. 2 in accordance with an embodiment of the present invention.

FIG. 3 illustrates the IR imager 152 within the first surveillance unit 104 (FIG. 2). The IR imager 152 may be formed of a focal plane array 160 of IR sensors 162, which may be dual element or two-pixel IR sensors, for example. The focal plane array 160 may be different sizes, such as 64×64 pixels or larger, and may be square, rectangular, or otherwise shaped. The IR sensors 162 are passive, meaning optionally have a digital signal processing (DSP) module 156 and an IR detection module 158 for analyzing the video and IR data as discussed further below.

The system control panel 102 has a control module 134 which provides control software and hardware to operate the system 100. Operating code 136 may be provided on a hard disk, ROM, flash memory, stored and run on a CPU card, or other memory. An input/output (I/O) port 138 provides a communications interface at the system control panel 102 with a central monitoring station 146 which may be connected wirelessly, by telephone link, LAN, WAN, internet, and the like. The I/O port 138 may also provide communication with external devices such as laptop computers.

The central monitoring station 146 is typically located remote from the system 100 and may monitor multiple alarm systems. The central monitoring station 146 may receive communications from the system control panel 102 regarding security problems and alarm conditions as well as real-time video and IR data acquired by the first through N surveillance units 104-108. The central monitoring station 146 may have one or more DSP modules 180 and one or more IR detection modules 182 for analyzing and processing video and IR data from one or more systems 100.

FIG. 2 illustrates a block diagram of the first surveillance unit 104. Although the first surveillance unit 104 is discussed, it should be understood that the second through N surveillance units 106 and 108 may be configured and operate in the same manner. The first surveillance unit 104 may comprise a visible light camera 150 and an IR imager 152 held within a housing 154. Alternatively, the visible light camera 150 and the IR imager 152 may be held separate from each other.

The visible light camera 150 and the IR imager 152 have the same FOV which defines the area the first surveillance unit 104 monitors and detects visible images and IR radiation within. An IR value detection module 153 may be separate from or integrated with the IR imager 152 and used to detect a level of IR sensed by the IR imager 152. The visible light camera 150 and the IR imager 152 operate simultaneously to acquire video data and long wave IR radiation data, respectively. A that IR radiation is received or detected but not transmitted. A lens 174 may be comprised of materials such as silicon, zinc selenide, or germanium, and is used to focus FOV 176 onto the focal plane array 160.

The IR sensors 162 receive or detect any long wave IR radiation within the FOV 176, which may also be referred to as black body radiation. Each of the IR sensors 162 produces an IR value, such as a voltage level, which reflects the amount of IR energy hitting the IR sensor 162. If dual element IR sensors are used, each of the two pixels may produce a separate IR value. The IR value detection module 153 (FIG. 2) detects the IR values for each IR sensor 162. For example, a higher voltage may be associated with a higher level of IR and a lower voltage may be associated with a lower level of IR.

The IR imager 152 may produce a high contrast frame 166 having an approximate block outline 178 of an intruder 168 detected within the FOV 176. Face area 170 of the intruder 168 generates a higher temperature (and higher voltage) compared to torso area 172 which is covered with clothing. Clothing reduces the surface temperature a few degrees, and thus less IR radiation is emitted and detected from covered areas. Areas having a higher temperature are displayed as lighter or brighter on the high contrast frame 166 compared to areas having cooler temperatures.

The high contrast frame 166 or image produced by the focal plane array 160 may be segmented, wherein each segment reflects IR data detected by a single IR sensor 162. Because the same FOV 176 is used for both the IR imager 152 and the visible light camera 150 (FIG. 2), the image data acquired by the visible light camera 150 may be virtually segmented to correlate with the IR data acquired by the IR imager 152. The block outline 178 within the high contrast frame 166 may also be referred to as a heat signature, and may be used by the IR detection module 158 to generate a region of interest (ROI) within the IR data. The ROI is then transferred to corresponding video data to minimize the amount of video data analyzed by the DSP module 156.

Figure 4:
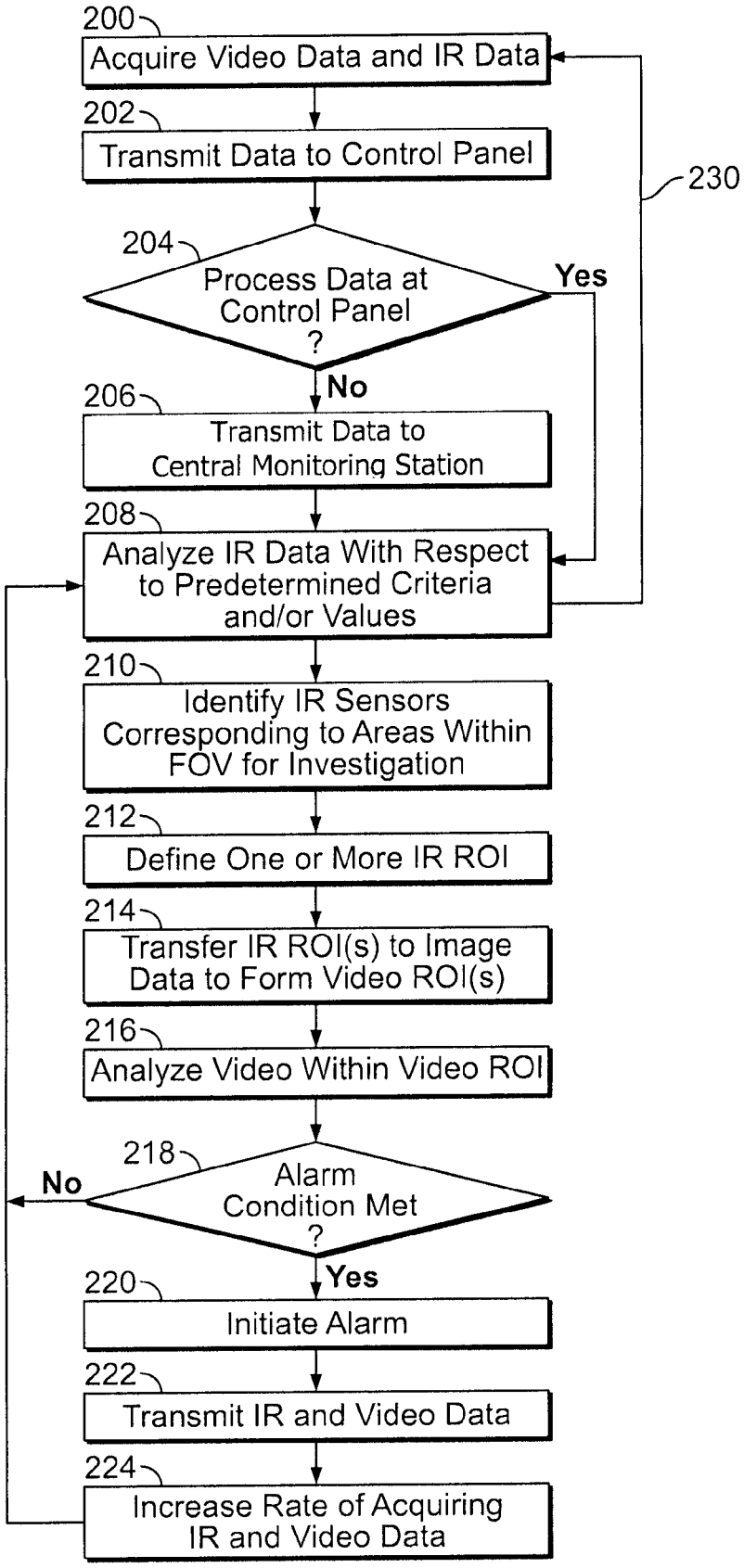
FIG. 4 illustrates a method for using the first surveillance unit of FIG. 3 to detect the presence and location of the intruder and other animate objects such as animals within the FOV in accordance with an embodiment of the present invention.

FIG. 4 illustrates a method for using the first surveillance unit 104 of FIG. 3 to detect the presence and location of the intruder 168 and other animate objects such as animals within the FOV 176. At 200, the first surveillance unit 104 acquires video data and IR data simultaneously within the FOV 176. In other words, the processor 164 simultaneously acquires IR data frames of IR data detected by the IR sensors 162 of the IR imager 152 and video frames of video data acquired by the visible light camera 150. The IR data frames and video data frames may be linked together by a time stamp, for example. It should be understood that data acquisition formats other than frames of data may be used, such as streaming video.

For the system 100 of FIG. 1, each of the first through N surveillance units 104 through 108 acquire the image and IR data frames from within their respective FOVs, unless commanded otherwise by the control module 134. Upon initial activation, the processor 164 may acquire frames of data at a predetermined rate, such as one frame every one, two or five seconds, such as until the IR detection module 158 detects IR data to be further investigated.

At 202, the processor 164 transmits the video and IR data frames to the control panel 102 as they are acquired. At 204, if an IR detection module 158 is not available at the control panel 102, the method passes to 206 where the processor 140 transmits the video and IR data frames to the central monitoring station 146 for analysis. It should be understood that some or all of the analysis and processing may be accomplished at the control panel 102, the central monitoring station 146, or a combination of the two. Also, the video and IR data may be transmitted to the central monitoring station 146 regardless of analysis being performed at the control panel 102.

Returning to 204, the analysis and/or processing may be accomplished in the same manner without regard to the location of the IR detection module 158 and the DSP module 156. Thus, the method passes to 208 from both 204 and 206. The method returns to 200 via line 230, indicating that 200-206 are accomplished continually and concurrently with the analysis and processing below.

At 208, the IR detection module 158 analyzes the IR data detected by each of the IR sensors 162 (FIG. 3) and compares the IR data to predetermined values, criteria, and the like. The IR data may be a level of voltage as discussed previously. For example, the IR data may be compared to a predetermined threshold or filtered with filter 159. The threshold may be set based on a minimum anticipated level of IR radiation received when an animate object is within the FOV 176. Alternatively, maximum and minimum IR levels may be compared to a predetermined IR range. Alternatively, IR levels within the current IR data frame may be compared to a previous IR data frame to detect change in temperature. IR sensors 162 having a change in IR radiation outside of a predetermined range may be further investigated. It should be understood that other methods may be used to detect, filter, and/or define levels of IR radiation which may be caused by intruders, suspicious action, and the like. Alternatively, the processor 140 may utilize an image processing algorithm to determine which pixel, if any, has IR data representing a level above the threshold.

At 210, the processor 140 identifies any IR sensors 162 corresponding to areas within the FOV 176 which require further investigation. If no IR sensor 162 is to be investigated, the IR data frame and corresponding video data frame may be discarded or archived.

Figure 5:
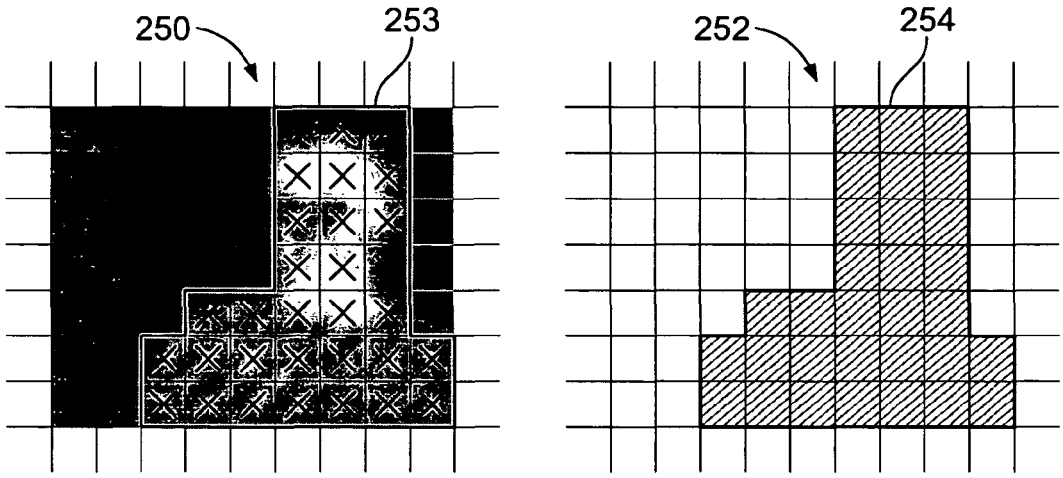
FIG. 5 illustrates a first IR data frame and a first video data frame in accordance with an embodiment of the present invention.

FIG. 5 illustrates a first IR data frame 250 and a first video data frame 252. A matrix or grid on both the first IR data frame 250 and the first video data frame 252 illustrate locations within the FOV 176 corresponding to the IR sensors 162 of the IR imager 152. Therefore, one identified segment of the first IR data frame 250 has a corresponding segment within the first video data frame 252 representing the same portion of the FOV 176. Optionally, each segment may be defined by more than one IR sensor 162, and may be represented by a maximum, average or median IR value, for example, within a matrix of IR values. The IR sensors 162 which are identified at 210 (FIG. 4) to be investigated are indicated with an X on the first IR data frame 250 for clarity.

Returning to FIG. 4, at 212, the processor 140 defines one or more IR region of interest (ROI) based on the identified IR sensors 162 (in 210) in the first IR data frame 250. For example, a first IR ROI 253 may be formed corresponding to the IR sensors 162 detecting the intruder 168 (FIG. 3). If a second intruder were present and not overlapping the intruder 168 within the FOV 176, a second ROI separate from the first IR ROI 253 may be identified.

At 214, the processor 140 transfers the first IR ROI 253 to the first video data frame 252 as first video ROI 254. At 216, the DSP module 156 analyzes the video content within the first video ROI 254. This relieves the burden on the DSP module 256 as only a portion of the first video data frame 252 may need to be analyzed. Optionally, the DSP module 256 may analyze image data only when a first video ROI 254 is identified.

At 218, the DSP module 156 may determine whether the data within the first video ROI 254 indicates a false alarm, an intruder, or otherwise meets an alarm condition and warrants further investigation. For example, the DSP module 156 may compare the first video ROI 254 to exemplary heat signatures generated by people or animals. Alternatively, the DSP module 156 may identify that the first video ROI 254 corresponds to a window which has received a large amount of light, resulting in a level of detected IR that is beyond a threshold. If it is during the day, this may be identified as a false alarm. If it is during the night, it may be determined that an unauthorized entry may be attempted. Optionally, the first video ROI 254 may be monitored for movement. If the DSP module 156 determines that a false alarm is indicated, the method returns to 208 to process the next IR data frame. If the DSP module 156 determines that an alarm condition has been met, the method passes to 220.

At 220, if the analysis and processing are accomplished at the control panel 102, the processor 140 may send an alarm signal through the I/O port 138 to the central monitoring station 146 where appropriate action is initiated. If the analysis and processing are accomplished at the central monitoring station 146, the DSP module 180 may initiate an alarm signal locally.

At 222, the processor 140 may transmit all of the IR and video data frames to the central monitoring station 146 if desired or if necessary for analysis and/or processing. Alternatively, at 224, the processor 140 within the control panel 102 may direct the processor 164 within the first surveillance unit 104 to acquire, sample, and/or detect IR and image data frames at an increased rate. The method returns to 208 to evaluate subsequent IR data frames.

Alternatively, once the first video ROI 254 is defined, the processor 140 may process subsequent video data frames based on the first video ROI 254. The processor 140 can thus track the movement of the intruder 168 over time while enhancing the video image to identify whether the intruder 168 is an authorized person. The combined data gathered by the visible light camera 150 and the IR imager 152 allow improved tracking of the intruder 168.

Also, the processor 140 may track the intruder 168 as they move out of the FOV 176 of the first surveillance unit 104 to a FOV of any of the second through N surveillance units 106-108 based on previously acquired data. For example, the first surveillance unit 104 may detect a first set of video data frames and a first set of IR data frames. The second surveillance unit 106 may detect a second set of video data frames and a second set of IR data frames. The processor 140 may track the intruder 168 from the first set of frames to the second set of frames based on processing accomplished on prior data frames.

Figure 6:
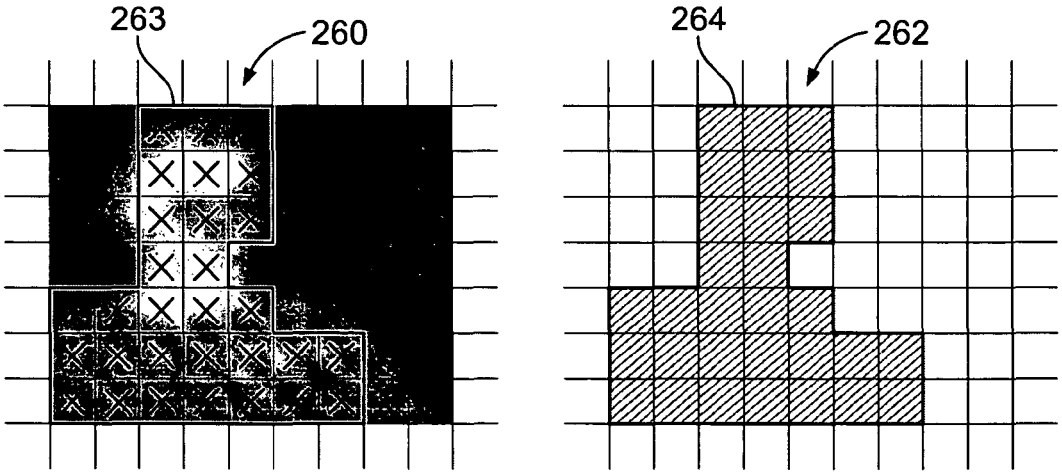
FIG. 6 illustrates a second IR data frame and a second video data frame in accordance with an embodiment of the present invention.

FIG. 6 illustrates a second IR data frame 260 and a second video data frame 262. The processor 140 has identified areas of the second IR data frame 260 having IR levels higher than the threshold (indicated with X), and a second IR ROI 263 is indicated. The second IR ROI 263 is transferred to the second video data frame 262 as corresponding second video ROI 264. It can be seen that the intruder has moved to a different location within the FOV 176 of the first surveillance unit 104 when compared to the first IR data frame 250 and first video data frame 252 of FIG. 5. The intruder 168 is thus being tracked throughout the area being monitored by the first surveillance unit 104.

As discussed previously, if multiple intruders are present, multiple ROIs may be generated and tracked. More than one intruder may be tracked from frame to frame and thus authorities know how many intruders are present, know whether they have an animal such as a dog with them, and know the locations of all intruders.

False positives may be avoided by identifying other heat generating situations, such as sunlight and space heaters. Also, an authorized person may be more easily identified by using the DSP module 156 to enhance the video data frame and thus avoid a false alarm. Knowing the location of authorized personnel with respect to the intruder 168 may improve the safety of the authorized personnel. In addition, the location of any person who may need assistance is better known, such as if they have been attacked or are incapacitated. Also, by using the IR imager 152, time and safety are enhanced by knowing whether an intruder 168 has left the monitored area, eliminating the need for security personnel to wait outside unnecessarily.

While the invention has been described in terms of various specific embodiments, those skilled in the art will recognize that the invention can be practiced with modification within the spirit and scope of the claims.

What is claimed is:

1. A security system, comprising:

a surveillance unit comprising a visible light camera configured to detect video data from within a first field of view (FOV) at a first rate and an infrared (IR) imager configured to detect IR data within the first FOV;

an IR detection module configured to determine whether at least a portion of the IR data is one of within a predetermined IR range, above a predetermined IR threshold, and below a predetermined IR threshold;

a digital signal processing (DSP) module; and a processor configured to identify a region of interest (ROI) within the video data based on an output of the IR detection module, the ROI comprising a portion of the first FOV that is less than the first FOV, the visible light camera further configured to detect the video data at a second rate that is increased with respect to the first rate after the ROI is identified, the processor further configured to transmit the video data to the DSP module, the DSP module configured to automatically analyze the video data within the ROI.

2. The security system of claim 1, the IR imager further comprising an array of IR sensors, wherein a portion of the IR sensors detect the IR data corresponding to the portion of the first FOV.

3. The security system of claim 1, the IR imager further comprising an array of IR sensors, wherein a portion of the IR sensors detect the IR data corresponding to the portion of the first FOV, the processor segmenting the video data based on the array of IR sensors.

4. The security system of claim 1, the IR imager further comprising an array of IR sensors, wherein a portion of the IR sensors detect the IR data corresponding to the portion of the first FOV, the ROI being based at least in part on positions of the IR sensors.

5. The security system of claim 1, wherein the DSP module is further configured to analyze the video data within the ROI based on at least one of predetermined IR levels, predetermined shapes, and heat signatures.

6. The security system of claim 1, further comprising a second surveillance unit comprising a second visible light camera configured to detect video data within a second FOV and a second IR imager configured to detect IR data within the second FOV, the second FOV being at least partially different than the first FOV.

7. The security system of claim 1, wherein the processor is further configured to initiate a security alert based on an output of the DSP module.

8. A method for detecting an intruder with a security system, comprising:

acquiring video data at a first rate with a visible light camera, the video data representative of a first field of view (FOV);

acquiring infrared (IR) data representative of the first FOV with an array of infrared (IR) sensors, the IR data forming a matrix of IR values;

identifying a first region of interest (ROI) with a processor, the first ROI comprising a portion of the first FOV that is less than the first FOV, the first ROI being based on the IR data and at least one predetermined IR parameter;

after the first ROI is identified, acquiring the video data at a second rate with the visible light camera, the second rate being increased with respect to the first rate;

transmitting the video data to a digital signal processing (DSP) module; and automatically analyzing the video data within the first ROI with the DSP module to determine if an intruder is present within the first FOV.

9. The method of claim 8, wherein at least one of the IR sensors within the array is capable of providing more than one IR value at the same time.

10. The method of claim 8, further comprising acquiring the video data and the IR data in corresponding data frames.

11. The method of claim 8, the method further comprising initiating an alarm with at least one of the processor and the DSP module when the intruder is present within the FOV.

12. The method of claim 8, further comprising defining a second ROI within the video data with the processor, wherein the first and second ROIs are separate from each other, the automatically analyzing further comprising automatically analyzing the video data within the first and second ROIs at the same time.

13. The method of claim 8, further comprising:

acquiring video data representative of a second FOV with a second visible light camera, the second FOV being at least partially different than the first FOV;

acquiring IR data representative of the second FOV with a second array of IR sensors; and defining, with the processor, a second ROI within the video data representative of the second FOV based on at least the first ROI.

14. The method of claim 8, further comprising tracking the intruder over time by defining a second ROI with the processor based at least in part on the first ROI.

15. A security system, comprising:

a visible light camera configured to detect video data within a first field of view (FOV);

an infrared (IR) imager comprising a group of N IR sensors, the IR sensors configured to detect IR data within the first FOV, the IR data being associated with levels of IR radiation within the first FOV;

a digital signal processing (DSP) module; and a processor configured to identify the IR sensors that detect levels of the IR data that are at least one of within a predetermined range, above a predetermined threshold and below a predetermined threshold, the processor further configured to transmit the video data corresponding to the identified IR sensors to the DSP module, the DSP module configured to automatically analyze the video data corresponding to the identified IR sensors, the DSP module further configured to enhance the video data corresponding to the identified IR sensors, the identified IR sensors comprising less than N IR sensors.

16. The security system of claim 15, wherein the identified IR sensors correspond to a previously processed area of the video data, the processor further configured to define a subsequent area of video data for processing based on the previously processed area of the video data.

17. The security system of claim 15, wherein at least one of the DSP module or the processor initiates a security alert based on an output of the DSP module.

18. The security system of claim 16, wherein the levels of IR data represent one of a level of voltage, heat, frequency, and wavelength.

* * * * *

UNITED STATES PATENT AND TRADEMARK OFFICE

CERTIFICATE OF CORRECTION

PATENT NO. : 7,791,477 B2
APPLICATION NO. : 11/504865
DATED : September 7, 2010
INVENTOR(S) : Raman Kumar Sharma It is certified that error appears in the above-identified patent and that said Letters Patent is hereby corrected as shown below:

Col. 10, claim 18:

Line 1:
Whereas, "The security system of claim 16" should be corrected to read "The security system of claim 15"

Signed and Sealed this

Ninth Day of November, 2010

David J. Kappos

David J. Kappos
*Director of the United States Patent and Trademark Office*